US010483660B2

(12) United States Patent
Liefsoens et al.

(10) Patent No.: US 10,483,660 B2
(45) Date of Patent: Nov. 19, 2019

(54) HOUSING WITH SELF-ORIENTING GROUNDING STUD

(71) Applicant: COMMSCOPE CONNECTIVITY BELGIUM BVBA, Kessel-Lo (BE)

(72) Inventors: Ronnie Rosa Georges Liefsoens, Tessenderlo (BE); Robert Vanhentenrijk, Winksele (BE)

(73) Assignee: CommScope Connectivity Belgium BVBA, Kessel-Lo (BE)

( * ) Notice: Subject to any disclaimer, the term of this patent is extended or adjusted under 35 U.S.C. 154(b) by 0 days.

(21) Appl. No.: 16/064,371

(22) PCT Filed: Dec. 29, 2016

(86) PCT No.: PCT/EP2016/082898
§ 371 (c)(1),
(2) Date: Jun. 20, 2018

(87) PCT Pub. No.: WO2017/114935
PCT Pub. Date: Jul. 6, 2017

(65) Prior Publication Data

US 2019/0006774 A1 Jan. 3, 2019

Related U.S. Application Data

(60) Provisional application No. 62/273,128, filed on Dec. 30, 2015.

(51) Int. Cl.
*H01R 4/30* (2006.01)
*H01R 4/64* (2006.01)
(Continued)

(52) U.S. Cl.
CPC ..... *H01R 4/643* (2013.01); *H01R 4/26* (2013.01); *H01R 4/302* (2013.01); *H01R 4/34* (2013.01); *H01R 13/521* (2013.01)

(58) Field of Classification Search
CPC ..... H01R 4/643; H01R 4/26; H01R 4/302; H01R 13/521; H01R 4/34
(Continued)

(56) References Cited

U.S. PATENT DOCUMENTS 3,197,895 A 8/1965 Cooke
4,683,390 A * 7/1987 Imori ..... H02K 11/046 310/71
(Continued)

FOREIGN PATENT DOCUMENTS

WO 98/42047 A1 9/1998

OTHER PUBLICATIONS

International Search Report and Written Opinion of the International Searching Authority for International Patent Application No. PCT/EP2016/082898 dated Mar. 1, 2017, 14 pages.
(Continued)

*Primary Examiner* — Abdullah A Riyami
*Assistant Examiner* — Nelson R. Burgos-Guntin
(74) *Attorney, Agent, or Firm* — Merchant & Gould P.C.

(57) ABSTRACT

A self-aligning grounding stud arrangement (100) for a housing (120) includes a grounding stud (210) that extends from a first end (212) outside the housing (120) to a second end (214) inside the housing (120). An anti-rotation flange (230) of the grounding stud (210) is received by an anti-rotation receiver (138) of the housing (120). The grounding stud (210) includes a first attachment feature (220) positioned between the first end (212) of the grounding stud (210) and the anti-rotation flange (230) and further includes a second attachment feature (260) positioned between the second end (214) of the grounding stud (210) and the anti-rotation flange (230). The housing (120) includes at least one guide (140) for rotationally orienting the anti-rotation flange (230) with the anti-rotation receiver (138).

19 Claims, 9 Drawing Sheets

(51) Int. Cl.
*H01R 13/52* (2006.01)
*H01R 4/34* (2006.01)
*H01R 4/26* (2006.01)

(58) Field of Classification Search
USPC ..... 439/100, 97, 801
See application file for complete search history.

(56) References Cited

U.S. PATENT DOCUMENTS 4,954,084 A * 9/1990 Pugh ..... H01R 4/66 439/100
6,027,382 A * 2/2000 Reindl ..... B23K 9/20 439/793
6,042,431 A * 3/2000 Hayakawa ..... H01R 4/305 439/801
6,280,263 B1 * 8/2001 Manor ..... H01R 11/12 439/801
6,413,005 B1 7/2002 Massie
7,281,962 B2 * 10/2007 Dolzer ..... H01R 4/305 411/81
7,713,071 B2 * 5/2010 Pearce ..... H01R 4/302 439/97
8,162,702 B2 * 4/2012 Opper ..... B25B 23/00 439/793
8,523,505 B2 * 9/2013 Opper ..... H01R 4/302 411/377
8,944,859 B2 * 2/2015 Kamor ..... H01R 4/304 174/51
2007/0177959 A1 8/2007 Chopp et al.
2008/0118325 A1 * 5/2008 Opper ..... H01R 4/302 411/103
2012/0244729 A1 * 9/2012 Rivera ..... H02S 20/24 439/97
2015/0171408 A1 * 6/2015 Naganawa ..... H01M 2/30 429/182

OTHER PUBLICATIONS

Grounding bolt images, 3 images, 2 pages, admitted as prior art as of Dec. 30, 2015.

* cited by examiner

FIG. 8
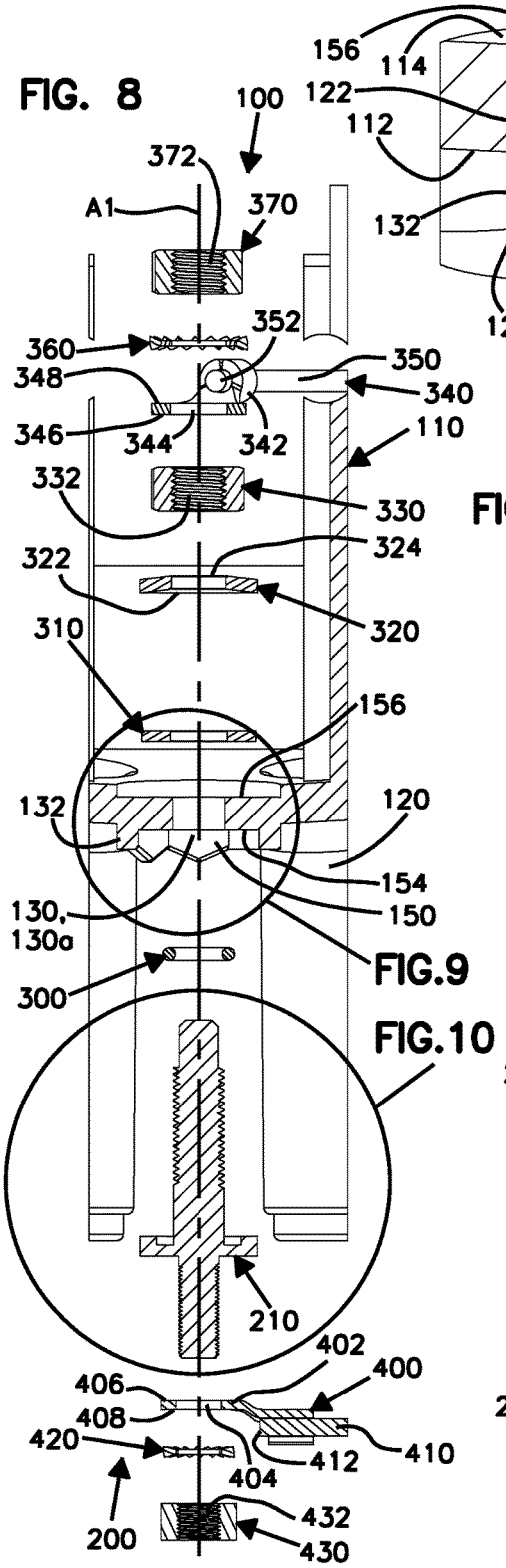
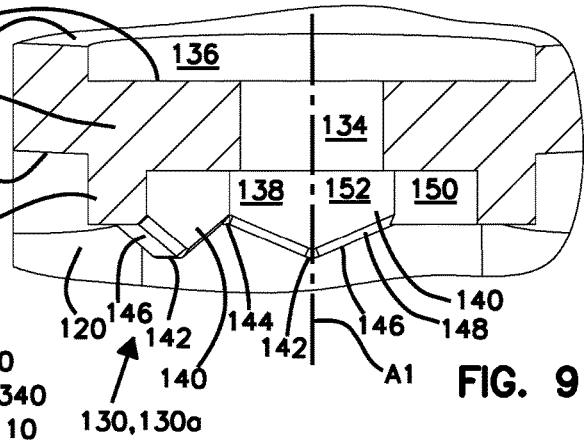
FIG. 9
FIG. 10
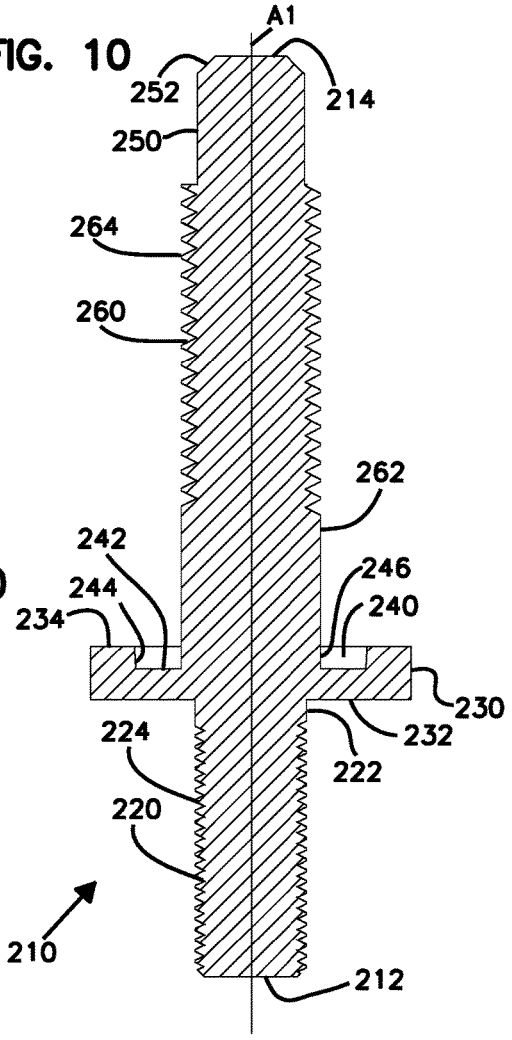

FIG. 11
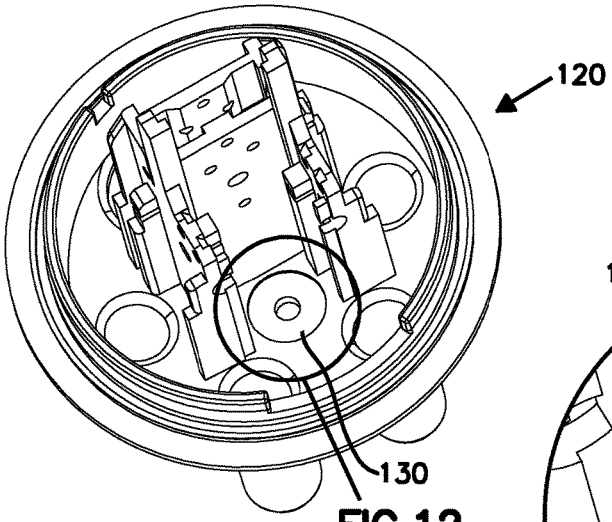
FIG.12
FIG. 12
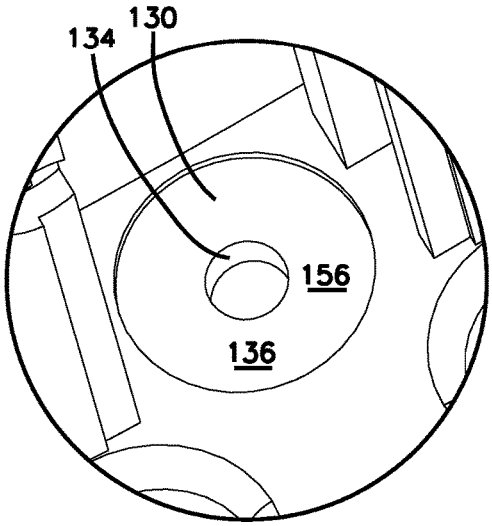
FIG.14
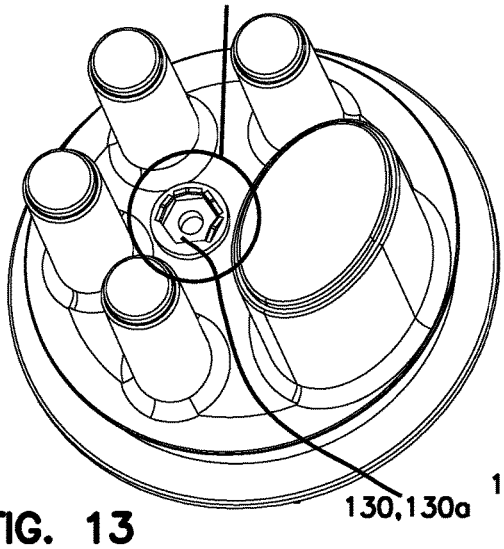
FIG. 13
FIG. 14
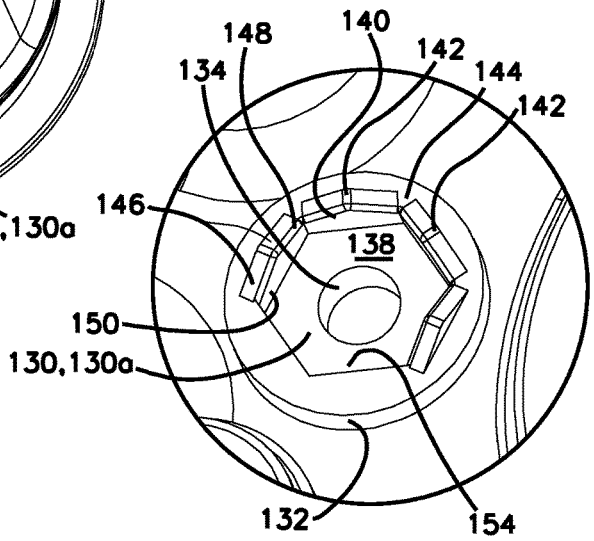

HOUSING WITH SELF-ORIENTING GROUNDING STUD

CROSS-REFERENCE TO RELATED APPLICATION

This application is a National Stage Application of PCT/EP2016/082898, filed on Dec. 29, 2016, which claims the benefit of U.S. Patent Application Ser. No. 62/273,128, filed on Dec. 30, 2015, the disclosures of which are incorporated herein by reference in their entireties. To the extent appropriate, a claim of priority is made to each of the above disclosed applications.

TECHNICAL FIELD

The present disclosure relates to electrical grounding of housings and/or enclosures. In particular, the present disclosure relates to the electrical grounding of housings and/or enclosures for telecommunications equipment.

BACKGROUND

In the field of telecommunications, there is a need to electrically ground certain enclosures and/or housings. The electrical grounding may be used to dissipate static electricity, provide a return path for electrical power, provide a safety ground in case of equipment malfunction, etc. Certain enclosures/housings are made of nonconductive material (e.g., plastic, fiber glass, etc.). As the enclosure/housing may not readily conduct electricity, a grounding stud may be passed through a wall of the housing/enclosure and thereby provide a grounding point on an exterior and interior of the enclosure/housing.

In certain applications, the enclosure/housing needs to be water-proof or water-resistant. In particular water, moisture, cleaning fluids, etc. present at the exterior of the housing/enclosure should be prevented by the housing/enclosure from reaching components within the interior of the enclosure/housing. Various rating systems (e.g., IP67) have been established to classify various levels of water resistance of various enclosures. To provide such water resistance around the grounding stud, a seal may be used to seal the grounding stud against an opening through a wall of the enclosure/housing.

The grounding stud may include threaded connections for attaching terminals to the grounding stud at the interior and/or the exterior of the enclosure/housing. To facilitate installing and/or removing the terminals from the threaded connections, the grounding stud may be rotationally connected to the enclosure/housing.

SUMMARY OF THE DISCLOSURE

The present disclosure relates to a grounding stud arrangement including a grounding stud assembly and a housing. The grounding stud assembly includes a ground stud that extends from a first end to a second end with an anti-rotation flange position between the first end and the second end of the grounding stud. The grounding stud includes a first attachment feature positioned between the first end of the grounding stud and the anti-rotation flange. The grounding stud further includes a second attachment feature positioned between the second end of the grounding stud and the anti-rotation flange. The housing includes a wall with a hole and an anti-rotation receiver. A portion of the grounding stud is positioned within the hole and at least a portion of the anti-rotation flange is received by the anti-rotation receiver. The housing further includes at least one guide for rotationally orienting the anti-rotation flange with the anti-rotation receiver.

Other aspects of the present disclosure relate to a method of assembling a grounding stud arrangement. The grounding stud arrangement includes a grounding stud assembly and a housing. The grounding stud assembly includes a grounding stud extending from a first end to a second end with an anti-rotation flange positioned between the first end and the second end of the grounding stud. The method includes providing the housing, inserting the second end of the grounding stud through a hole of the housing, and rotationally orienting the anti-rotation flange of the grounding stud with an anti-rotation receiver of the housing. The anti-rotation flange of the grounding stud is rotationally oriented with the anti-rotation receiver by engaging the anti-rotation flange with at least one guide of the housing and further inserting the grounding stud through the hole.

Still other aspects of the present disclosure relate to a housing with provisions for grounding at least one component within an interior of the housing. The housing includes a wall, a hole in the wall, an anti-rotation receiver, and at least one guide. The hole in the wall is configured to receive a portion of a grounding stud. The anti-rotation receiver is configured to receive at least a portion of an anti-rotation flange of the grounding stud. The at least one guide is configured to rotationally orient the anti-rotation flange with the anti-rotation receiver.

A variety of additional inventive aspects will be set forth in the description that follows. The inventive aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

FIG. 8 is the cross-sectional elevation view of FIG. 7, but exploded;

FIG. 9 is an enlarged portion of FIG. 8;

FIG. 10 is an enlarged portion of FIG. 8;

FIG. 11 is a perspective view of the housing of FIG. 1;

FIG. 12 is an enlarged portion of FIG. 11;

FIG. 13 is another perspective view of the housing of FIG. 1;

FIG. 14 is an enlarged portion of FIG. 13;

DETAILED DESCRIPTION

Figure 1:
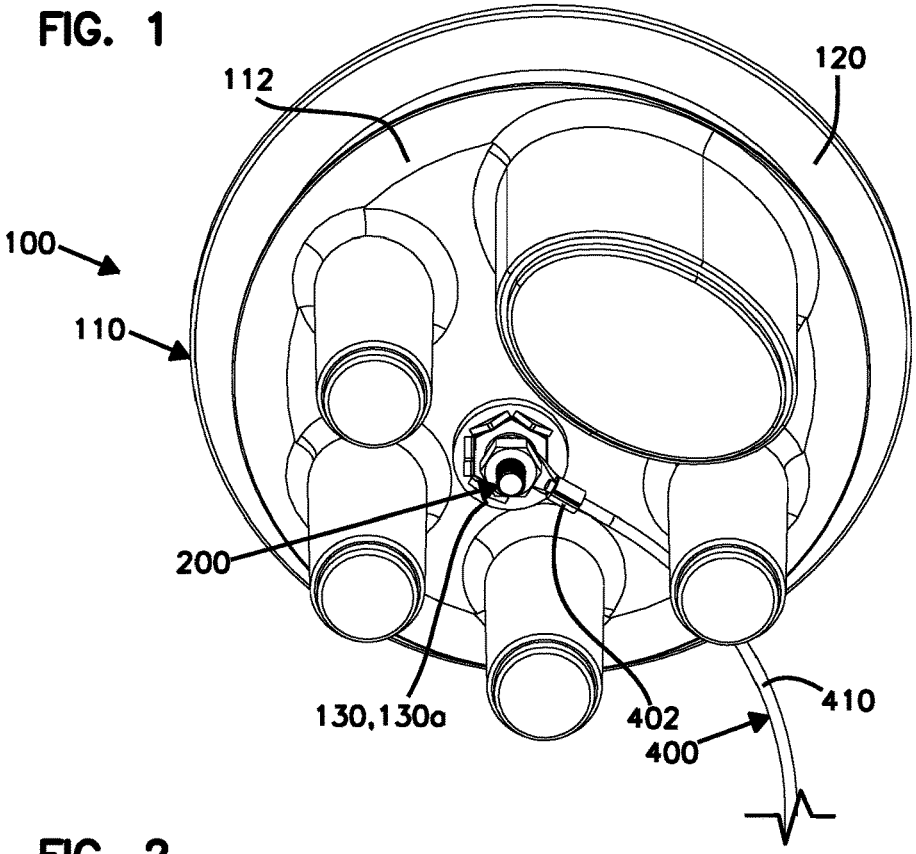
FIG. 1 is a perspective view of an example housing with an example grounding stud assembly mounted thereon.
Figure 2:
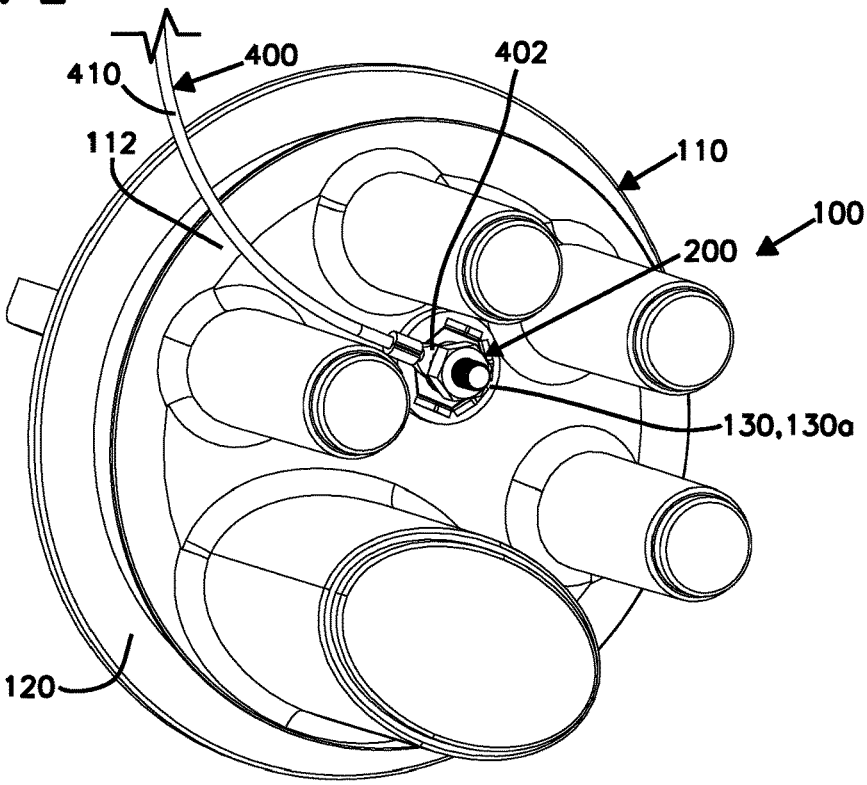
FIG. 2 is another perspective view of the housing and the grounding stud assembly of FIG. 1.
Figure 3:
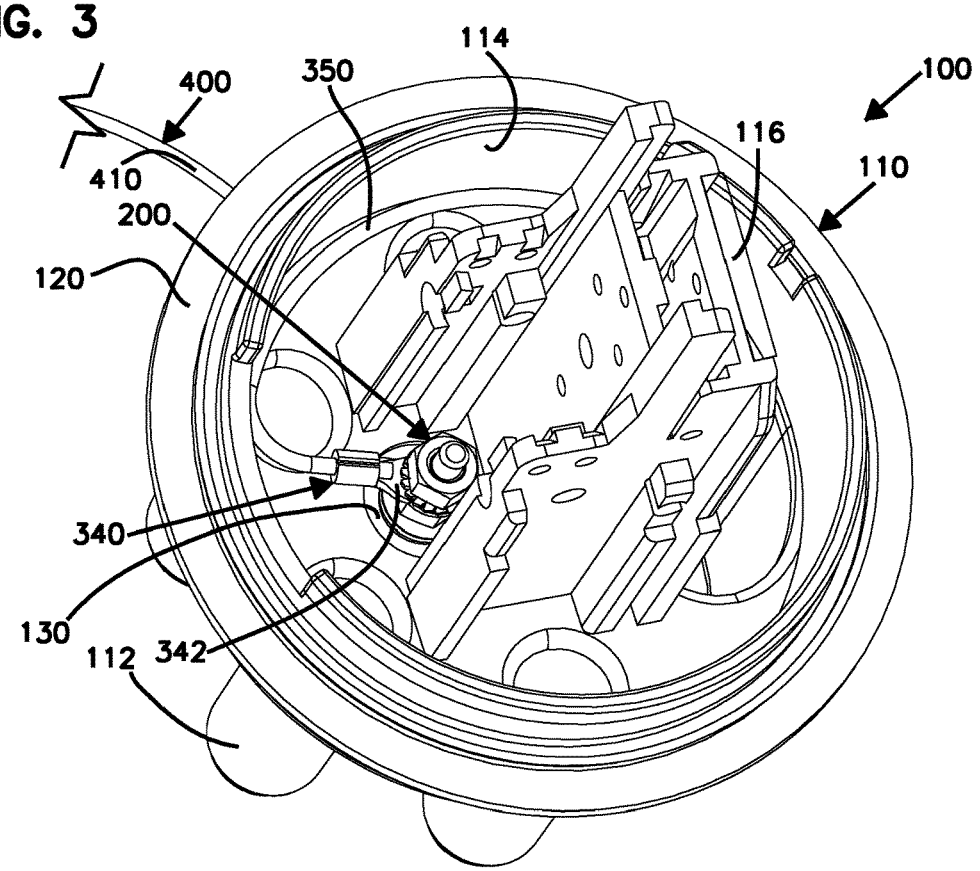
FIG. 3 is still another perspective view of the housing and grounding stud assembly of FIG. 1.
Figure 4:
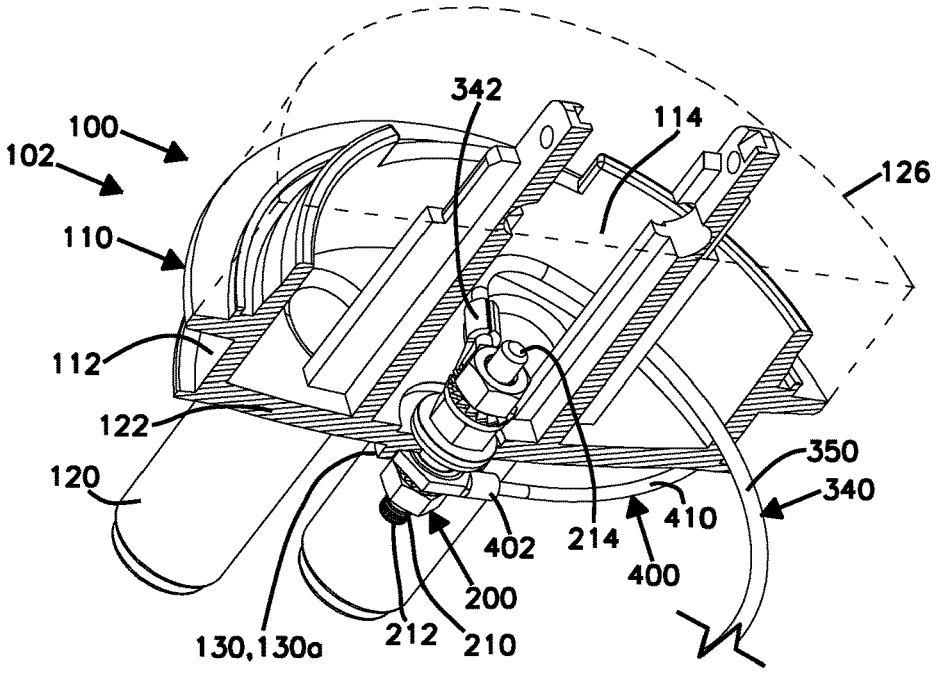
FIG. 4 is yet another perspective view of the housing and the grounding stud assembly of FIG. 1, with the housing shown cut away.

According to the principles of the present disclosure, a housing assembly 102 is provided with a grounding stud assembly 200 and thereby forms a grounding stud arrangement 100. As depicted at FIG. 4, the housing assembly 102 includes a housing piece 120 and a housing piece 126. In certain embodiments, a grounding stud arrangement 100 may be formed by a housing piece 120 and the grounding stud assembly 200. The housing piece 120 and the housing piece 126 may thereby form an enclosure 110 with an exterior 112 and an interior 114. One or more components 116 may be housed within the interior 114 of the enclosure 110 (see FIG. 3). The grounding stud assembly 200 may provide electrical grounding to the component 116 within the interior 114. In particular, the grounding stud assembly 200 includes a grounding stud 210 that extends between a first end 212 and a second end 214. As depicted, the first end 212 is positioned outside the enclosure 110, and the second end 214 is positioned inside the enclosure 110. The grounding stud 210 is made of an electrically conductive material. The grounding stud 210 may thereby ground the component 116 within the interior 114 of the enclosure 110, even if the enclosure 110 is made of an electrically non-conductive material.

According to the principles of the present disclosure, the grounding stud 210 is rotationally held by a mount 130 of the housing piece 120. Furthermore, the grounding stud 210 is rotationally oriented with respect to the mount 130 automatically when positioning the grounding stud 210 into the mount 130. As will be described in detail below, by inserting the grounding stud 210 into the mount 130 along an axis A1, rotational alignment is established between the grounding stud 210 and the mount 130 of the housing piece 120.

Turning again to FIGS. 1-5, the enclosure 110 will be described in detail. In the depicted embodiment, the enclosure 110 includes the housing piece 120. The housing piece 120 includes a wall 122 that separates the interior 114 from the exterior 112. As depicted, the mount 130 may be a feature on the wall 122 of the housing piece 120. As depicted, the mount 130 is included on a boss 132 that rises above the exterior 112 of the wall 122. In other embodiments, the boss 132 may be raised from the interior 114 of the wall 122. As depicted, the boss 132 includes a cylindrical perimeter centered on the axis A1.

The mount 130 further includes a hole 134. As depicted, the hole 134 is a cylindrical bore through the wall 122 that is centered on the axis A1. As depicted, the mount 130 further includes a counter bore 136 positioned at the interior 114 of the wall 122. As depicted, the counter bore 136 is also centered on the axis A1.

As depicted, the mount 130 includes an anti-rotation receiver 138. As depicted, the anti-rotation receiver 138 is formed in a pocket positioned within the boss 132. The anti-rotation receiver 138 includes anti-rotation features. As depicted, the anti-rotation receiver 138 includes a faceted perimeter 150 about the pocket. In the depicted embodiment, the faceted perimeter 150 is a multi-faceted perimeter. In other embodiments, the faceted perimeter 150 may include a single facet 152. In the depicted embodiment, the faceted perimeter 150 includes a plurality of the facets 152. As depicted at FIG. 14, the faceted perimeter 150 is in a form of a hexagon with six of the facets 152 centered about the axis A1. As depicted, the facets 152 of the faceted perimeter 150 meet each other at an intersection edge. In other embodiments, the individual facets 152 may be spaced from each other. As depicted at FIG. 14, the six facets 152 together form six flats of a female hexagonal pocket. As depicted, the anti-rotation receiver 138 includes a seat 154 at the bottom of the pocket. The seat 154 thereby also has a hexagonal perimeter. In other embodiments, the seat 154 may be separated from the facets 152. As depicted at FIGS. 8 and 9, the counter bore 136 includes a seat 156 opposite about the wall 122 from the seat 154.

Turning now to FIGS. 10 and 15-18, the grounding stud 210 will be described in detail. As depicted, the grounding stud 210 includes a first attachment feature 220 adjacent the first end 212 of the grounding stud 210. As depicted, the first attachment feature 220 includes first threads 224. In other embodiments, the first attachments feature 220 may include various other attachment features such as one or more set screws, clips, attachment blades, etc. The first attachment feature 220 may further include a radial surface 222. As depicted, the radial surface 222 is positioned opposite the first end 212 about the first threads 224.

As depicted, the grounding stud 210 includes an anti-rotation flange 230. As depicted, the anti-rotation flange 230 is a medial flange positioned between the first end 212 and the second end 214 of the grounding stud 210. As depicted, the anti-rotation flange 230 extends from a first shoulder 232 to a second shoulder 234. The first shoulder 232 is adjacent the radial surface 222. As depicted, the anti-rotation flange 230 includes a faceted perimeter 236. The faceted perimeter 236 includes at least one facet 238. In the depicted embodiment, the faceted perimeter 236 is a multi-faceted perimeter with a plurality of the facets 238. In the depicted embodiment, the faceted perimeter 236 includes a hexagonal perimeter. As depicted, the male hexagonal perimeter is centered about the axis A1.

As depicted, the anti-rotation flange 230 includes a sealing member groove 240. In the depicted embodiment, the sealing member groove 240 is an O-ring groove. As depicted, the sealing member groove 240 is positioned beneath the second shoulder 234. The sealing member groove 240 extends from the second shoulder 234 to a bottom 242 along the axis A1. The sealing member groove 240 further extends between an outer wall 244 and an inner wall 246. As depicted, the inner wall 246 of the sealing member groove 240 is coincident with a radial surface 262 that extends toward the second end 214 from the anti-rotation flange 230.

As depicted, the radial surface 262 is included on a second attachment feature 260 of the grounding stud 210. The second attachment feature 260 further includes second threads 264. The second threads 264 extend from the radial surface 262 to a pilot 250. A chamfer 252 is included between the pilot 250 and the second end 214 of the grounding stud 210.

As illustrated at FIG. 8, the grounding stud assembly 200 may further include a sealing member 300, a washer 310, a Belleville washer 320, a first nut 330, a first lock washer 360, a second nut 370, a second lock washer 420, and a third nut 430. In certain embodiments, the grounding stud assembly 200 may further include an internal ground conductor assembly 340 and/or an external ground conductor assembly 400. In other embodiments, the internal ground conductor assembly 340 may be included with the component 116. In other embodiments, the internal ground conductor assembly 340 may be a feature of the enclosure 110 (e.g., a grounding bus). In certain embodiments, the external ground conductor assembly 400 may be included with a power cable, a rack, a utility pole, etc.

As depicted, the internal ground conductor assembly 340 includes a terminal 342 with an eyelet 344. The internal ground conductor assembly 340 further includes a wire 350 that is terminated at the terminal 342 at an end 352 of the wire 350. Similarly, the external ground conductor assembly 400 is depicted as including a terminal 402 with an eyelet 404. The external ground conductor assembly 400 further includes a wire 410 with an end 412 that is terminated at the terminal 402.

As mentioned above, according to the principles of the present disclosure, the grounding stud 210 and/or the grounding stud assembly 200 is automatically rotationally aligned with the anti-rotation receiver 138 of the grounding stud mount 130 of the housing piece 120. As depicted at FIGS. 5-9, 13, 14, and 19-23, a plurality of guides 140 and/or 140' is positioned about the mount 130. As depicted, the guides 140, 140' are positioned beyond the boss 132 away from the wall 122. In other embodiments, one or more guides may be mounted directly on the wall 122. In certain embodiments, one or more guides may be spaced from the anti-rotation receiver 138. At least one of the guides 140, 140' rotationally orients the anti-rotation flange 230 with the anti-rotation receiver 138. As depicted, the housing piece 120 includes a plurality of the guides 140, 140' for rotationally oriented the anti-rotation flange 230 with the anti-rotation receiver 138. As depicted the guides 140, 140' are each an extension of one of the facets 152, respectively.

As depicted, two of the facets 152 do not include a corresponding one of the guides 140. A terminal exit 160 for the terminal 402 may thereby be provided by the absence of one or more of the guides 140, 140' from the facets 152. As depicted, a pair of the guides 140, 140' is positioned opposite the axis A1. In other embodiments, all of the facets 152 may include a corresponding one of the guides 140, 140'.

Figure 19:
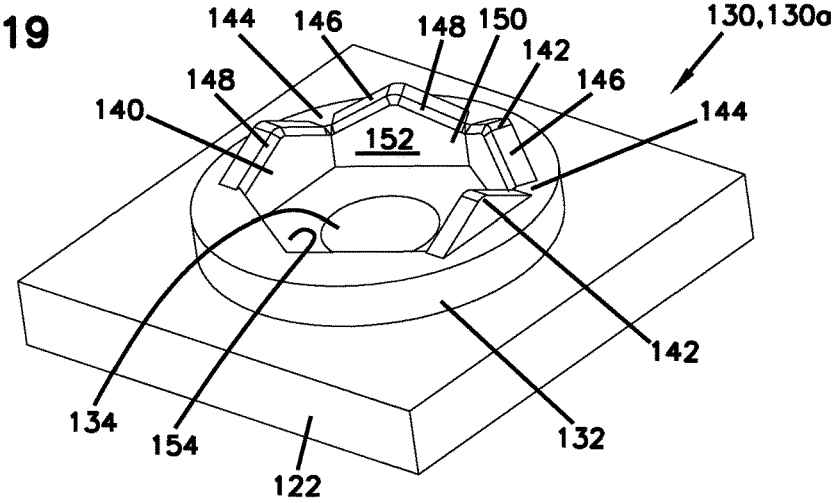
FIG. 19 is a cutaway perspective view of a grounding stud mount of the housing of FIG. 1.
Figure 20:
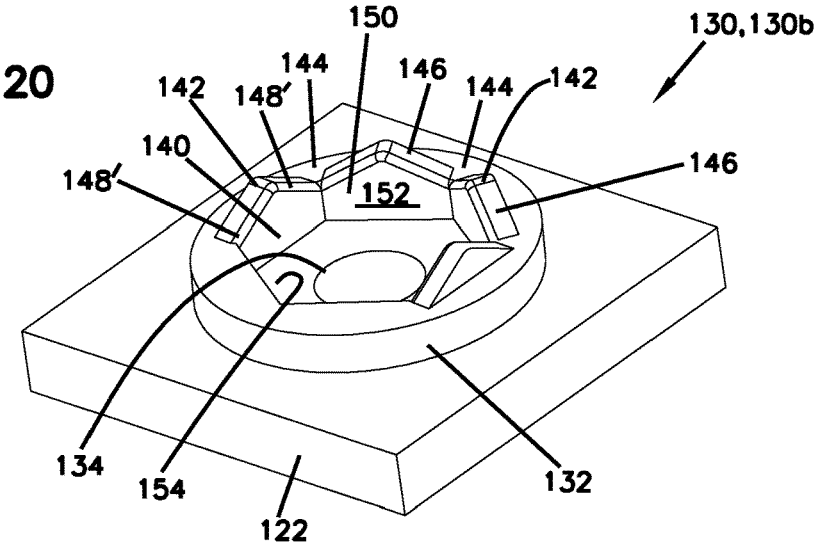
FIG. 20 is a cutaway perspective view of another grounding stud mount compatible with the housing of FIG. 1.
Figure 22:
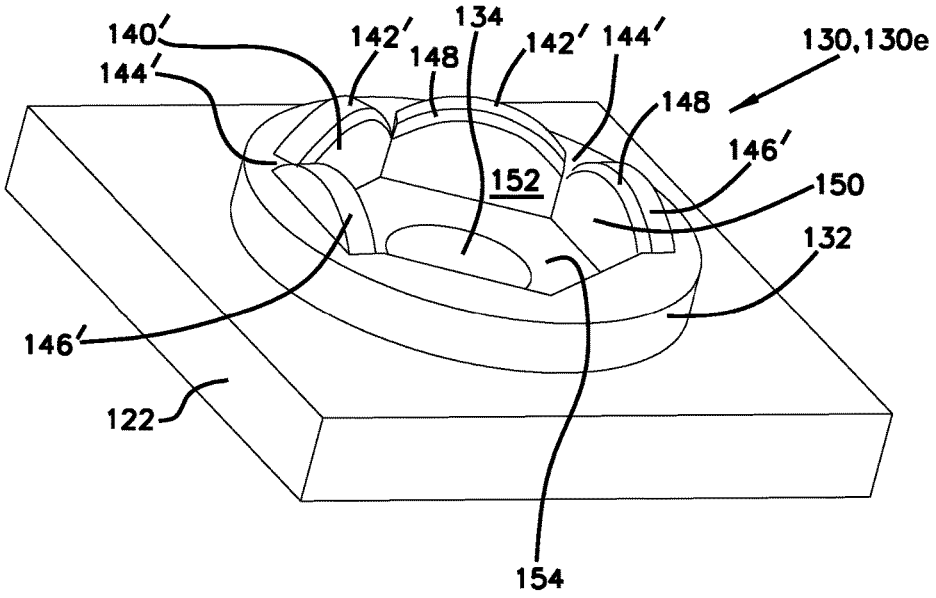
FIG. 22 is a cutaway perspective view of yet another grounding stud mount compatible with the housing of FIG. 1.
Figure 23:
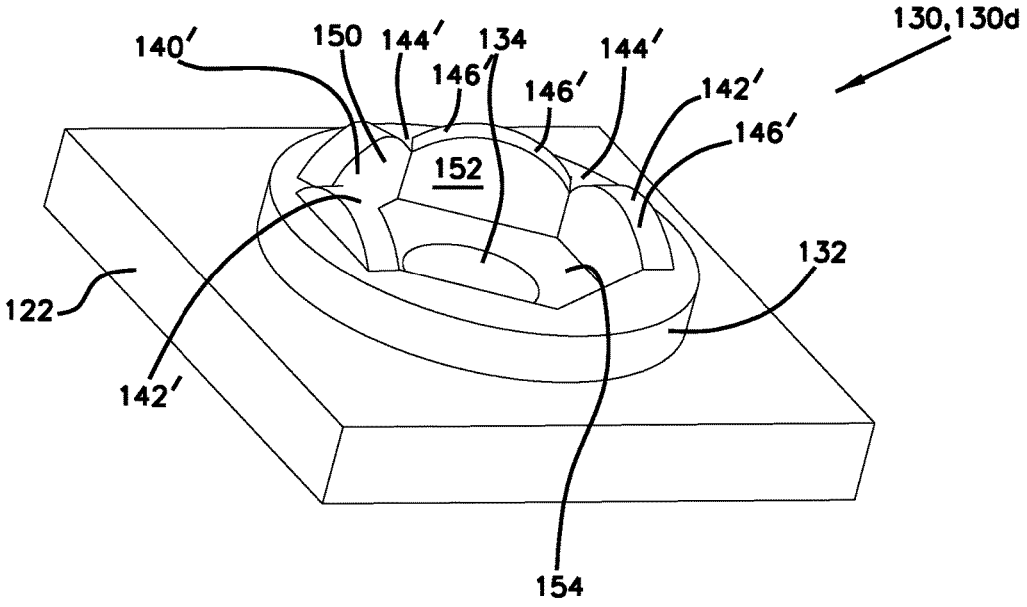
FIG. 23 is a cutaway perspective view of still another grounding stud mount compatible with the housing of FIG. 1.

As depicted, the plurality of the guides 140, 140' together form a plurality of the peaks 142, 142' and valleys 144, 144'. A plurality of slopes 146, 146' is formed between the plurality of peaks 142, 142' and valleys 144, 144', respectively. As depicted at FIGS. 19, 20, and 22, contoured edges may be formed on the guides 140, 140' in certain of the depicted embodiments, chamfers 148 are depicted as the contoured edges at FIGS. 19 and 22, and rounds 148' are depicted as the contoured edges at FIG. 20. As illustrated at FIGS. 21 and 23, contoured edges 148, 148' may be omitted from the guides 140.

Figure 21:
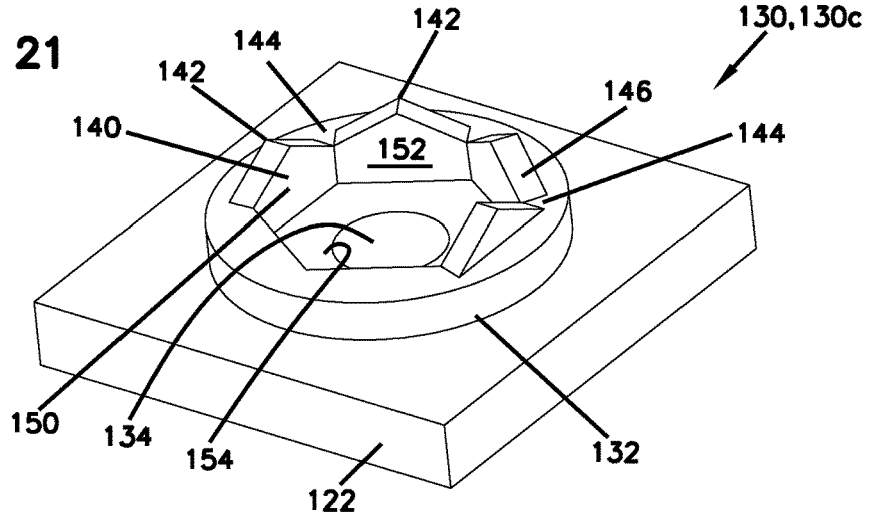
FIG. 21 is a cutaway perspective view of still another grounding stud mount compatible with the housing of FIG. 1.

As depicted at FIGS. 19-21, the guides 140 include slopes 146 that linearly transition between the peaks 142 and the valleys 144. The guides 140 thereby form a plurality of triangular features that progressively engage the anti-rotation flange 230 of the grounding stud 210. As depicted at FIGS. 22 and 23, the guides 140' include curved slopes 146' that extend between the peaks 142' and the valleys 144'. In the depicted embodiments, the curved slopes 146' are in a form of circular arcs that extend from the anti-rotation receiver 138. The curved slopes 146' thereby progressively engage the anti-rotation flange 230 of the grounding stud 210 as the grounding stud 210 is inserted through the hole 134 of the grounding stud mount 130.

The mount 130 with the triangular guides 140 and chamfered edges 148 is given reference numeral 130*a* at FIG. 19. The mount 130 with the triangular guides 140 and rounded edges 148' is given reference numeral 130*b* at FIG. 20. An example mount 130 with the triangular guide 140 and a sharp edge is given reference number 130*c* at FIG. 21. An example mount 130 with the curved guide 140' and a sharp edge is given reference number 130*d* at FIG. 23. And, a mount 130 with the curved guide 140 and the chamfered edge 148 is given reference number 130*e* at FIG. 22. In certain embodiments, the various guides 140, 140' with the various edges 148, 148' may be combined in various combinations with one another. In other embodiments, guides with other shapes and with other edge treatments may be used.

Figure 15:
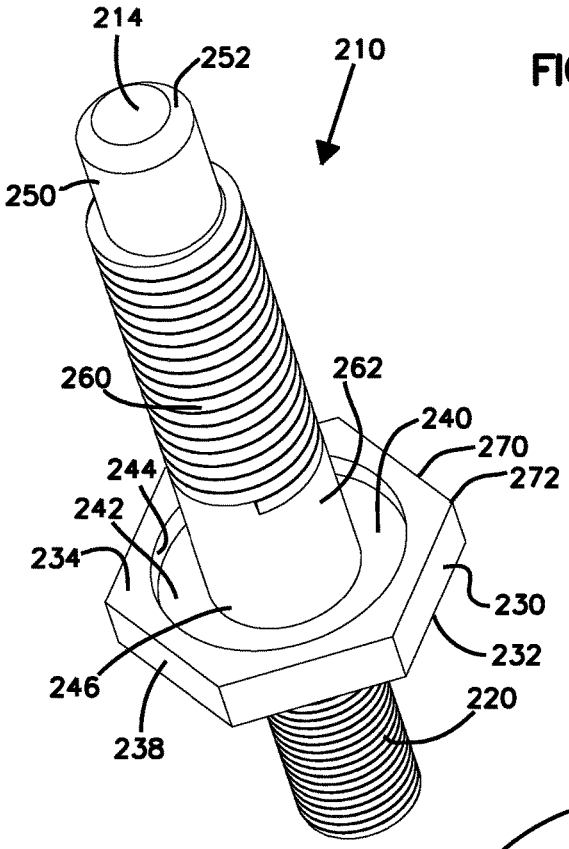
FIG. 15 is a perspective view of a grounding stud of the ground stud assembly of FIG. 1.
Figure 16:
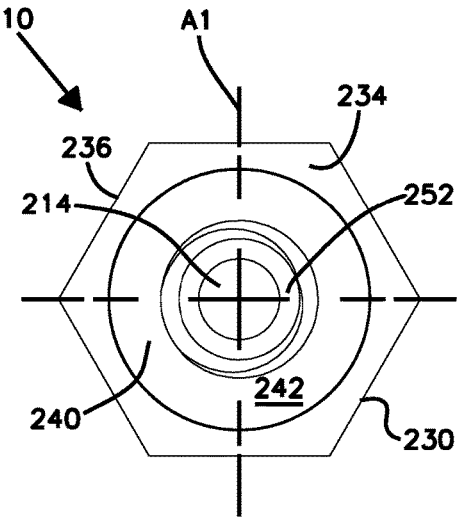
FIG. 16 is an end view of the grounding stud of FIG. 15.
Figure 17:
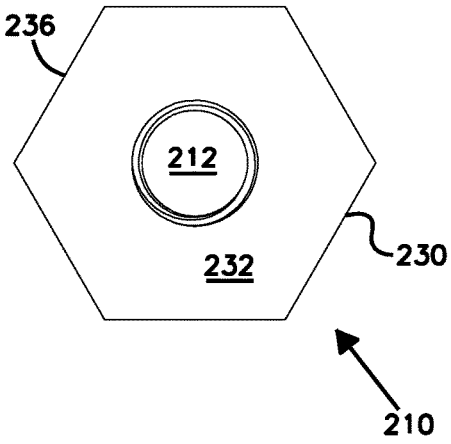
FIG. 17 is another end view of the grounding stud of FIG. 15.
Figure 18:
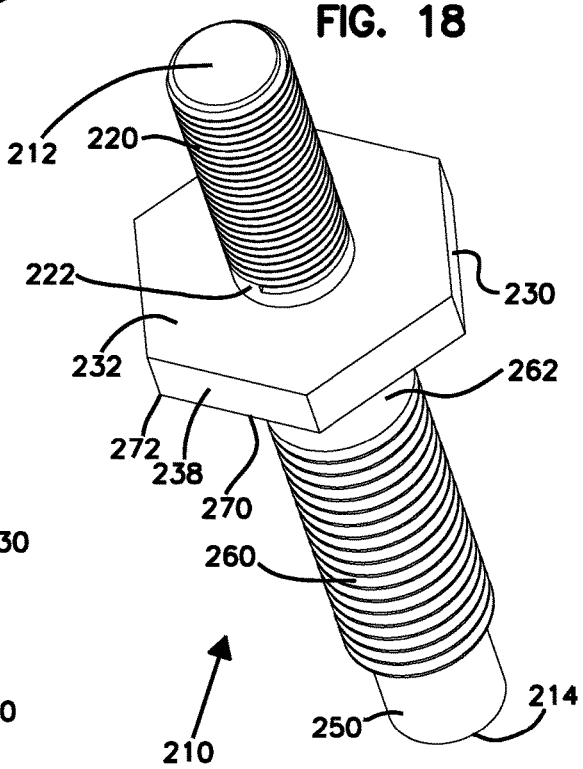
FIG. 18 is another perspective view of the grounding stud of FIG. 15.

The guides 140, 140' engage edges 270 and/or vertexes 272 of the second shoulder 234 of the anti-rotation flange 230 of the grounding stud 210 (see FIG. 15). In certain embodiments, various edge treatments may also be used to contour the edges 270 and/or the vertexes 272.

Figure 5:
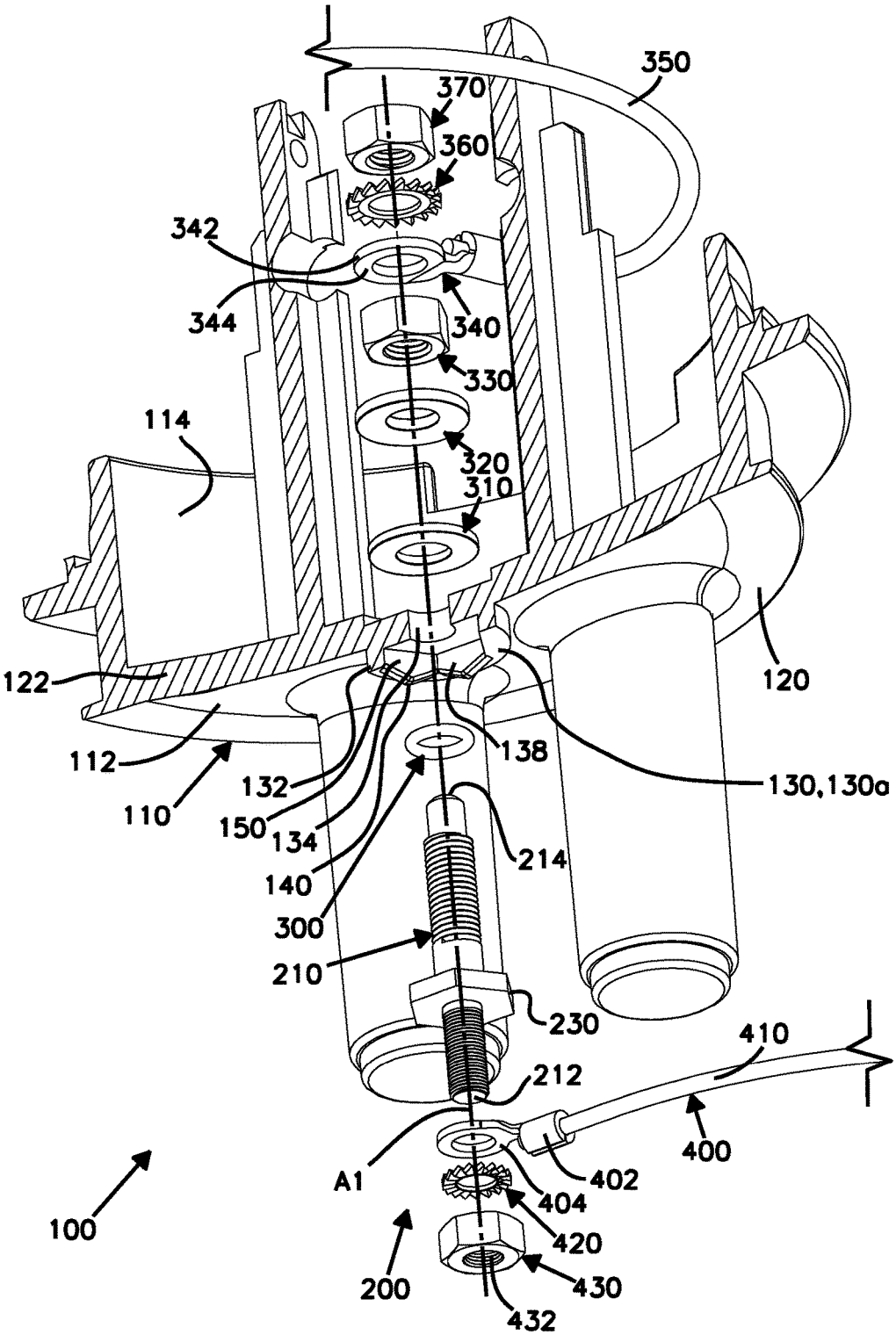
FIG. 5 is an exploded perspective view of the housing and the grounding stud assembly of FIG. 1, with the housing shown cut away.
Figure 7:
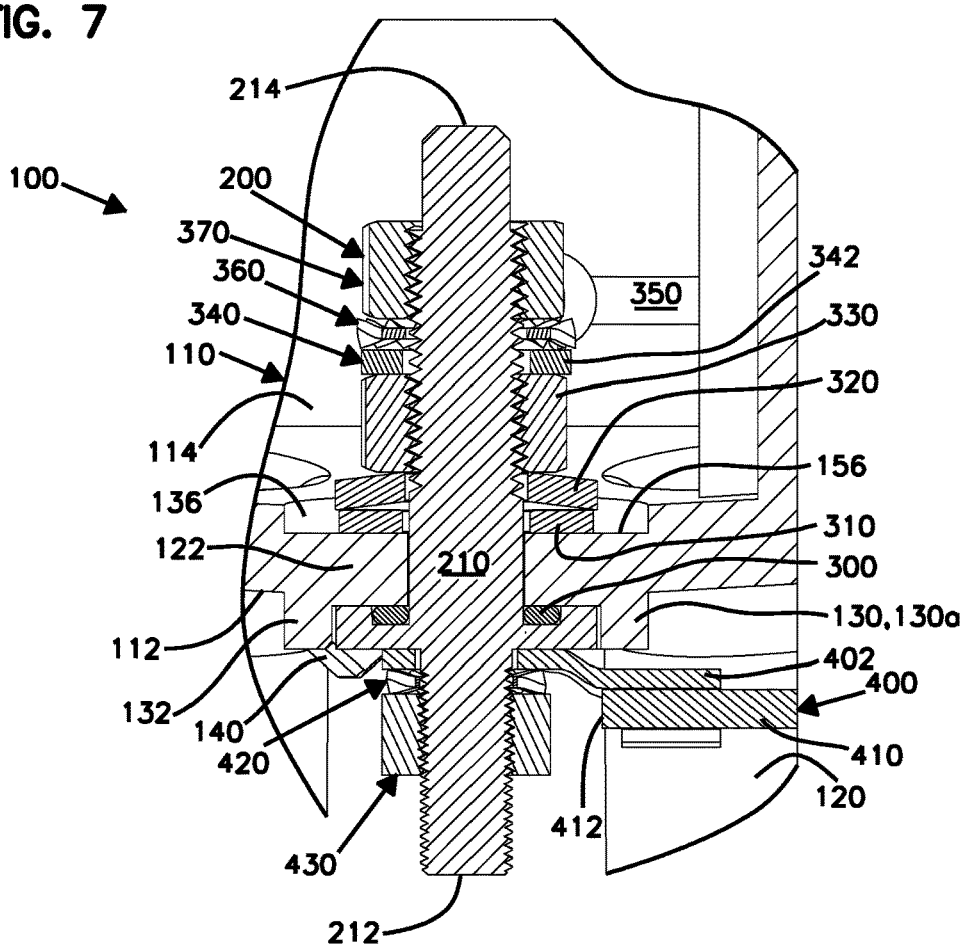
FIG. 7 is a cross-sectional elevation view of the housing and the grounding stud assembly of FIG. 1, as called out at FIG. 6.

Turning now to FIGS. 5, 7, and 8, a method of assembling the grounding stud arrangement 100 will be described in detail, according to the principles of the present disclosure. In particular, the grounding stud 210 may be sub-assembled by positioning the sealing member 300 over the second end 214 of the grounding stud 210 and onto the pilot 250. The sealing member 300 may be slid across the second threads 264 and over the radial surface 262 and finally into the O-ring groove 240. Upon the sealing member 300 being sub-assembled, the second end 214 of the grounding stud 210 may be inserted through the hole 134 of the grounding stud mount 130. The chamfer 252 may guide initial insertion of the second end 214 into the hole 134. The grounding stud 210 is then further translated along the axis A1. The anti-rotation flange 230 contacts the guides 140, 140' and thereby is automatically rotationally oriented with the anti-rotation receiver 138. In particular, the edges 270 and/or the vertexes 272 of the anti-rotation flange 230 engage the peaks 142, 142' and/or the slopes 146, 146'. Continued insertion along the axis A1 thereby rotates the grounding stud 210 until the anti-rotation flange 230 of the grounding stud 210 rotationally matches the anti-rotation receiver 138 of the grounding stud mount 130. Upon the rotational orientation matching, the anti-rotation flange 230 is fully insertable into the anti-rotation receiver 138. Upon the anti-rotation flange 230 being inserted into the anti-rotation receiver 138, relative rotation between the grounding stud 210 and the housing piece 120 is prevented by the facets 238 of the anti-rotation flange 230 engaging the facets 152 of the faceted perimeter 150. The washer 310 may now be assembled over the second end 214 of the grounding stud 210. The assembly of the washer 310 may be done from within the interior 114 of the enclosure 110. The washer 310 may seat against the seat 156 at the bottom of the counter bore 136. The Belleville washer 320 may likewise be installed over the second end 214 of the grounding stud 210. As depicted, a first side 322 of the Belleville washer bears against the washer 310. The nut 330 is similarly installed over the second end 214 of the grounding stud 210. Threads 332 of the nut 330 are threaded on the threads 264 of the second attachment feature 260. The second side 324 of the Belleville washer abuts the nut 330. The nut 330 is further threaded and may thereby compress the Belleville washer 320 and further compress the sealing member 300 when tightened. The Belleville washer 320 may perform as a spring and thereby regulate a clamping load that the nut 330 places on the wall 122 of the housing piece 120. The eyelet 344 of the terminal 342 of the internal ground conductor assembly 340 may be positioned over the second end 214 of the grounding stud 210. A first side 346 of the eyelet 344 is depicted as abutting the nut 330. The lock washer 360 may be positioned over the second end 214 of the grounding stud 210. The nut 370 may be positioned over the second end 214 of the grounding stud 210. Threads 372 of the nut 370 may be threaded onto the threads 264 of the second attachment feature 260. By tightening the nut 370, the lock washer 360 may bite into the eyelet 344 and thereby enhance an electrical connection. If the grounding stud arrangement 100 is being sub-assembled without the internal ground conductor assembly 340, assembling the terminal 342 may be omitted and the nut 370 may be tightened against the lock washer 360 and the nut 330 without the eyelet 344.

Connection of the external ground conductor assembly 400 to the grounding stud 210 will now be described in detail. The eyelet 404 of the terminal 402 of the external ground conductor assembly 400 may be positioned over the first end 212 of the grounding stud 210. This may be done from the exterior 112 of the enclosure 110. A first side 406 of the eyelet 404 is abutted against the first shoulder 232 of the anti-rotation flange 230 of the grounding stud 210. The eyelet 404 may be positioned about the radial surface 222. The lock washer 420 may be installed over the first end 212 of the grounding stud 210. The lock washer 420 may be positioned against a second side 408 of the eyelet. The nut 430 may be positioned over the first end 212 of the ground stud 210. Threads 432 of the nut 430 may be threaded on the first threads 224 of the grounding stud 210. Upon tightening the nut 430 against the lock washer 420, the lock washer 420 may bite into the second side 408 of the terminal 402 and thereby enhance an electrical connection between the external ground conductor assembly 400 and the grounding stud 210. The external ground conductor assembly 400 is thereby securely mechanically connected to the grounding stud 210. The external ground conductor assembly 400 is thereby electrically connected by the grounding stud assembly 200 to the internal ground conductor assembly 340.

In embodiments where the grounding stud assembly 200 is being sub-assembled to the grounding stud arrangement 100 without the external ground conductor assembly 400, assembling the eyelet 404 may be omitted and the nut 430 may be tightened against the lock washer 420 and the anti-rotation flange 230 without the eyelet 404.

Figure 6:
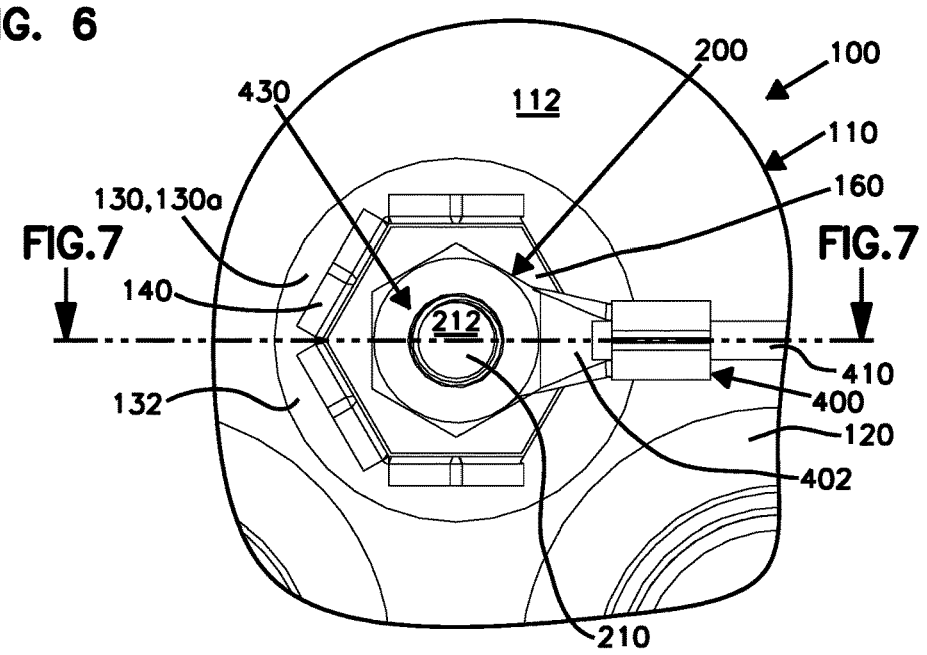
FIG. 6 is a plan view of the housing and the grounding stud assembly of FIG. 1.

As illustrated at FIG. 6, the terminal 402 may extend through the terminal exit 160 formed between the pair of opposing guides 140. The opposing guides 140 may thereby rotationally constrain the terminal 402 about the grounding stud 210.

PARTS LIST

A1 axis
100 grounding stud arrangement
102 housing assembly
110 enclosure
112 exterior
114 interior
116 component
120 housing piece
122 wall
126 housing piece
130 grounding stud mount
130*a* grounding stud mount
130*b* grounding stud mount
130*c* grounding stud mount
130*d* grounding stud mount
130*e* grounding stud mount
132 boss
134 hole
136 counter bore
138 anti-rotation receiver
140 guide
140' guide
142 peak
142' peak
144 valley
144' valley
146 slope
146' slope
148 chamfered edge
148' rounded edge
150 faceted perimeter
152 facet
154 seat
156 seat
160 terminal exit
200 grounding stud assembly
210 grounding stud
212 first end
214 second end
220 attachment feature
222 radial surface
224 threads
230 anti-rotation flange
232 shoulder
234 shoulder
236 faceted perimeter
238 facet
240 sealing member groove
244 outer wall
246 inner wall
250 pilot
252 chamfer
260 attachment feature (7)
262 radial surface
264 threads
270 edges
272 vertexes
300 sealing member
310 washer
320 Belleville washer
330 nut
332 threads
340 internal ground conductor assembly
342 terminal
344 eyelet
350 wire
352 end
360 lock washer
370 nut

372 threads
400 external ground conductor assembly
402 terminal
404 eyelet
410 wire
412 end
420 lock washer
430 nut
432 threads

What is claimed is:

1. A grounding stud arrangement comprising:

a grounding stud assembly including a grounding stud extending from a first end to a second end with an anti-rotation flange positioned between the first end and the second end of the grounding stud, the grounding stud including a first attachment feature positioned between the first end of the grounding stud and the anti-rotation flange and further including a second attachment feature positioned between the second end of the grounding stud and the anti-rotation flange; and a housing including a wall with a hole and an anti-rotation receiver, a portion of the grounding stud positioned within the hole and at least a portion of the anti-rotation flange received by the anti-rotation receiver, the housing further including at least one guide for rotationally orienting the anti-rotation flange with the anti-rotation receiver.

2. The grounding stud arrangement of claim 1, wherein the anti-rotation flange includes a faceted perimeter with at least one facet and wherein the anti-rotation receiver rotationally constrains the faceted perimeter of the anti-rotation flange.

3. The grounding stud arrangement of claim 2, wherein the anti-rotation receiver is at least partially formed as a pocket including a bottom and a faceted perimeter with at least one facet, wherein the anti-rotation flange seats against the bottom of the anti-rotation receiver, and wherein the faceted perimeter of the anti-rotation receiver rotationally constrains the faceted perimeter of the anti-rotation flange.

4. The grounding stud arrangement of claim 3, wherein the faceted perimeter of the anti-rotation receiver is a multi-faceted perimeter with a plurality of the facets and wherein the faceted perimeter of the anti-rotation flange is a multi-faceted perimeter with a plurality of the facets that engage the facets of the multi-faceted perimeter of the anti-rotation receiver, respectively.

5. The grounding stud arrangement of claim 4, wherein the housing includes a plurality of the guides for rotationally orienting the anti-rotation flange with the anti-rotation receiver, wherein the guides are each an extension of one of the facets, respectively.

6. The grounding stud arrangement of claim 5, wherein at least one of the facets does not include a corresponding one of the guides thereby providing a terminal exit.

7. The grounding stud arrangement of claim 5, wherein the plurality of the guides together form a plurality of peaks and valleys.

8. The grounding stud arrangement of claim 7, wherein the plurality of the guides includes contoured edges opposite the bottom of the anti-rotation receiver.

9. The grounding stud arrangement of claim 4, wherein the multi-faceted perimeter of the anti-rotation receiver is a female hexagonal perimeter and wherein the multi-faceted perimeter of the anti-rotation flange is a male hexagonal perimeter that engages the female hexagonal perimeter.

10. The grounding stud arrangement of claim 1, further comprising a sealing member positioned between the grounding stud and the housing.

11. The grounding stud arrangement of claim 10, wherein the grounding stud includes an O-ring groove and wherein the sealing member is an O-ring positioned at least partially within the O-ring groove.

12. The grounding stud arrangement of claim 3, further comprising a sealing member positioned between the anti-rotation flange and the bottom of the anti-rotation receiver.

13. The grounding stud arrangement of claim 12, wherein the anti-rotation flange includes an O-ring groove and wherein the sealing member is an O-ring positioned at least partially within the O-ring groove.

14. A method of assembling the grounding stud arrangement of claim 1, the method comprising:

providing the housing;

inserting the second end of the grounding stud through the hole of the housing; and rotationally orienting the anti-rotation flange of the grounding stud with the anti-rotation receiver of the housing by engaging the anti-rotation flange with the at least one guide of the housing and further inserting the grounding stud through the hole.

15. The method of claim 14, further comprising seating the anti-rotation flange of the grounding stud against a bottom of the anti-rotation receiver.

16. The method of claim 15, further comprising installing a sealing member over the second end of the grounding stud before inserting the second end of the grounding stud through the hole of the housing and compressing the sealing member between the anti-rotation flange of the grounding stud and the bottom of the anti-rotation receiver.

17. The method of claim 15, further comprising attaching the grounding stud to the housing by threading threads of a first nut onto threads of the second attachment feature.

18. The method of claim 17, further comprising attaching a first terminal to the grounding stud by positioning the first terminal on the grounding stud and threading threads of a second nut onto the threads of the second attachment feature and thereby clamping the first terminal between the first nut and the second nut.

19. The method of claim 18, further comprising attaching a second terminal to the grounding stud by positioning the second terminal on the grounding stud and threading threads of a third nut onto threads of the first attachment feature and thereby clamping the second terminal between the third nut and the anti-rotation flange.

* * * * *